United States Patent [19]

Herbert et al.

[11] Patent Number: 4,902,386

[45] Date of Patent: Feb. 20, 1990

[54] ELECTROFORMING MANDREL AND METHOD OF FABRICATING AND USING SAME

[75] Inventors: William G. Herbert, Williamson; Edouard E. Langlois; Duane C. Basch, both of Rochester; Peter J. Schmitt, Ontario, all of N.Y.

[73] Assignee: Xerox Corporation, Stamford, Conn.

[21] Appl. No.: 388,418

[22] Filed: Aug. 2, 1989

[51] Int. Cl.[4] ..... C25D 1/02

[52] U.S. Cl. ..... 204/9; 204/281

[58] Field of Search ..... 204/4, 9, 281

[56] References Cited

U.S. PATENT DOCUMENTS

| | | | |
|---|---|---|---|
| 3,669,849 | 6/1972 | Schmidt | 204/11 |
| 3,844,906 | 10/1974 | Bailey et al. | 204/9 |
| 4,024,045 | 5/1977 | Thierstein | 204/281 |
| 4,067,782 | 1/1978 | Bailey et al. | 204/25 |
| 4,501,646 | 2/1985 | Herbert | 204/4 |
| 4,530,739 | 7/1985 | Hanak et al. | 204/4 |

*Primary Examiner*—T. M. Tufariello

*Attorney, Agent, or Firm*—Peter H. Kondo

[57] ABSTRACT

A cylindrical electroforming mandrel and method of fabricating and using same, the mandrel having a substantially cylindrical mandrel core having substantially parallel sides and at least one tapered end having curved sides which converge toward an apex, and a plated metal coating on the parallel sides and the tapered end, the profile of an axial cross section of the tapered end from the intersection between the curved sides and the parallel sides to about the apex having the shape of half an ellipse defined by the formula:

$$y = \pm b/a \sqrt{(a^2 - x^2)}$$

where:

a=½ the length of the major axis of the ellipse and has a value between about 2.3b and about 1.7b, b=½ the height of the minor axis of the ellipse and has a value at least about 1,000 times greater than the thickness of said plated metal coating on said parallel sides, and x and y define a point lying along the outer surface of the ellipse measured from the center of the ellipse.

24 Claims, 2 Drawing Sheets

ELECTROFORMING MANDREL AND METHOD OF FABRICATING AND USING SAME

BACKGROUND OF THE INVENTION

This invention relates in general to electroforming and more specifically, to an electroforming mandrel and method of fabricating and using same.

Prior art mandrels utilized for electroforming operations are often plated with a metal to improve the durability of the mandrel and to facilitate removal of the electroformed article. These electroforming mandrels usually have straight parallel sides to facilitate removal of the electroformed article from the mandrel. A slight taper may be imparted to the mandrel sides in the direction of removal to further aid in the removal of the electroformed article. It is essential that the circumference of the sides along the axial length of the mandrel remain the same or decrease in size so that the electroformed article can be removed from the mandrel without damaging the electroformed article or the mandrel.

Electroforming mandrels of the prior art are usually coated with a protective metal layer to enhance durability and to facilitate removal of electroformed articles. When cylindrical mandrels having flat ends (e.g. ends in a plane that form a right-angle with the parallel sides) are plated by electroplating techniques, an edge effect is encountered due to electric current distribution characteristics. This edge effect results in thicker deposits at the ends of the parallel sides adjacent to the flat mandrel ends. These thicker deposits cause a plated mandrel to have a larger circumference at each mandrel end thereby preventing removal of the electroformed article from either end.

In order to prevent thick end deposits during plating of mandrels having flat ends, a disk shaped electrically conductive "robber" may be secured to each flat end of a mandrel. This arrangement allows the thicker deposits of plating material to form at the flat ends of the robbers rather than at the flat ends of the mandrel. After plating, the robbers are removed and the plated mandrel is used for electroforming. Unfortunately, the ends of this type of mandrel are not protected by any plating and, therefore, tend to corrode during use. End caps may be secured to the ends of the mandrel prior to electroforming to protect the unplated surfaces from corrosion. However, the intersection between the end caps and the plated surface of the mandrel is still susceptible to corrosion and causes a build up of deposits which resemble coral. Moreover, the electroformed material tends to form a deposit in the crevasse between the end caps and the ends of the mandrel core. To avoid these undesirable effects, a ring shaped shield may be applied to cover the intersection between the end cap and the end of the mandrel. Such shield must be applied to the mandrel prior to electroforming and must be removed subsequent to electroforming so that the electroformed article can be removed from the mandrel. These operations increase the number of handling operations per electroforming cycle and increases the likelihood that the outer surface of the electroformed article will be contaminated during handling by foreign materials such as finger prints.

Other techniques used to control the plated coating thickness include the use of shades and/or varying porosity screens which can be positioned within the bath to minimize the end effects. These techniques, however, require adjustments to accommodate any change in mandrel dimensions and/or changes in operating parameters. The electric current distribution pattern is so dependent on operating conditions that adjustment of shading during operation is necessary to compensate for normal changes in operating parameters during plating (e.g. temperature increases) to achieve the same results achieved with robbers. Learning how to move and position the shades for any given process requires exhaustive testing.

The many operations required for applying, adjusting and removing masks and bottom protectors increases the time and handling requirements and thwart conversion to rapid, automated processes that utilize, for example, automatic electroform parting techniques.

INFORMATION DISCLOSURE STATEMENT

U.S. Pat. No. 4,067,782 to Bailey et al., issued Jan. 10, 1978—A process is disclosed for nickel plating a cylindrically shaped hollow core mandrel suitable for chromium plating for use in an electroforming process for the production of endless seamless xerographic belt. The process comprising anodizing a hollow aluminum core, nickel plating the anodized core, optionally subjecting the plated core to an acid dip bath and thereafter plating the core with chromium.

U.S. Pat. No. 4,501,646 to Herbert, issued Feb. 26, 1985—An electroforming process is disclosed comprising providing a mandrel having certain coefficient of expansion characteristics and length to segmental cross-sectional area ratios in an electroforming bath to electroform a coating of a metal on the core mandrel and thereafter removing the coating under certain cooling conditions.

U.S. Pat. No. 3,844,906 to Bailey et al., issued Oct. 29, 1974—A process is disclosed for forming seamless nickel belts on a mandrel and removing the nickel belt from the mandrel under certain cooling conditions.

U.S. Pat. No. 4,024,045 to Thierstein, issued May 17, 1977—A master pattern cylinder is described comprising a roller body and a sleeve surrounding the roller body. In one embodiment, a thin-walled sleeve is described having an outer surface which is cylindrical and an inner surface which is frustum-shaped. In another embodiment, a roller body is fitted with a thin-walled sleeve having cylindrical inner and outer surfaces. The mandrel may be employed for producing perforated nickel sleeves by electrolytic deposition.

U.S. Pat. No. 4,530,739 to Hanak et al., issued July 23, 1985—A method of fabricating an electroplated substrate is described. The substrate is prepared in an electroforming process by electroplating onto and removing a metallic layer from the surface of a specially prepared mandrel. The surface of the cylindrical mandrel is substantially defect-free and may either be textured or smooth prior to electroplating metallic layer thereon.

U.S. Pat. No. 3,669,849 to Schmidt, issued June 13, 1972—A deposition process is disclosed using a mandrel having a surface with recessed areas and a means for facilitating deposition in the recessed areas.

Thus, there is a continuing need for electroforming mandrels that reduce the many operations required for applying, adjusting and removing masks and bottom protectors.

Accordingly, it is an object of this invention to provide an electroforming mandrel and process of preparing and using same which overcome the above-noted deficiencies.

It is another object of this invention to provide an electroforming mandrel and process of preparing and using same which eliminates the need for a robber.

It is another object of this invention to provide an electroforming mandrel and process of preparing and using same which eliminates the need for special shading.

It is another object of this invention to provide an electroforming mandrel and process of preparing and using same which eliminates the need for mandrel bottom protectors.

It is another object of this invention to provide an electroforming mandrel and process of preparing and using same which eliminates the need for masks.

It is another object of this invention to provide an electroforming mandrel and process of preparing and using same which simplifies removal of an electroform from the mandrel.

It is another object of this invention to provide an electroforming mandrel and process of preparing and using same which forms a protective coating free of protrusions.

These as well as other objects are accomplished by the present invention by providing a cylindrical electroforming mandrel comprising a substantially cylindrical mandrel core sides which converge toward an apex, and a plated metal coating on the parallel sides and the tapered end, the profile of an axial cross section of the tapered end from the intersection between the curved sides and the parallel sides to about the apex having the shape of half an ellipse by the formula:

$$y = \pm b/a \sqrt{(a^2 - x^2)}$$

a = ½ the length of the major axis of the ellipse and has a value between about 2.3b and about 1.7b, b = ½ the height of the minor axis of the ellipse and has a value at least about 1,000 times greater than the thickness of the plated metal coating on the parallel sides, and x and y define a point lying along the outer surface of the ellipse measured from the center of the ellipse.

This mandrel is fabricated by electroplating a metal onto the mandrel core. The plated coating on the mandrel core has a substantially uniform thickness on the parallel sides of the mandrel core. Also an imaginary line tangent to the cross sectional profile of the plated metal coating on the curved sides of the mandrel end in the direction from the the parallel sides to the apex is inclined toward the apex or parallel to the axis of the mandrel. This configuration ensures that there are no protrusions from the plated metal coating that would impede removal of the electroformed article from the ellipsoid shaped end of the mandrel. This plated mandrel is utilized in an electroforming process comprising immersing the electrode in a plating bath, electroforming an electroformed layer on the plated article from the mandrel by sliding the electroformed article over the ellipsoid shaped end of the mandrel.

As defined herein, an ellipsoid is a surface all plane sectios of which are ellipses. An ellipse is defined as a closed plane curve generated by a point so moving that the sum of the distances from two fixed points is a positive constant. A circle is defined as an ellipse where the two fixed points are positioned at the identical location. A major axis is the longest stright line connecting two points lying in the periphery of an ellipse. A minor axis is a straight line that intersects the center of and is perpendicular to the major axis. "y" is a distance from the major axis of the ellipse measured in a direction parallel to the minor axis. "x" is a distance from the minor axis of the ellipse measured in a direction parallel to the major axis.

Any suitable mandrel core may be utilized to fabricate the mandrel of this invention. The core mandrel may be solid and of large mass or hollow with means to heat or maintain the heat of the interior to prevent cooling of the mandrel while the deposited coating is cooled. Thus, the mandrel core preferably has high heat capacity, for example, in the range from about 3 to about 4 times the specific heat of the electroformed article material. This determines the relative amount of heat energy contained in the electroformed article compared to that in the core mandrel. Also, as well known in the art, at least the outer surface of the mandrel core should be electrically conductive. Further, the core mandrel preferably exhibits low thermal conductivity to maximize the difference in temperature (Delta T) between the electroformed article and the core mandrel during rapid cooling of the electroformed article to prevent any significant cooling and contraction of the core mandrel. In addition, a large difference in temperature between the temperature of the cooling bath and the temperature of the coating and mandrel core maximizes the permanent deformation due to the stress-strain hysteresis effect. A high thermal coefficient of expansion is also desirable in a core mandrel to optimize permanent deformation due to the stress-stain hysteresis effect. Although an aluminum core mandrel is characterized by a high thermal coefficient of expansion, it exhibits high thermal conductivity and low heat capacity which are less effective for optimum permanent deformation due to the stress-strain hysteresis effect. Typical mandrel cores include aluminum, mild steel, stainless steel, titanium, titanium palladium alloys, and the like, which have suitable structural integrity.

The cross-sectional configuration of the mandrel may be of any suitable shape. Typical shapes include circles, ovals, regular and irregular polygons such as triangles, squares, hexagons, octagons, rectangles and the like. If the mandrel has an unsymetrical cross-section, the values for "a" and "b" must be within ratio ranges defined herein below. For mandrels having a convex olygon cross-sectional shap, the distance across adjacent peaks of the cross-sectional shape is preferably at least twice the depth of the valley between the peaks (depth of the valley being the shortest distance from an imaginary line connecting the peaks to the bottom of the valley) to facilitate removal of the electroformed article from the mandrel without damaging the article and to ensure uniform wall thickness. It is importnt, however, that the circumference of the sides along the axial length of the mandrel remain the same or decrease in size so that the electroformed article can be removed from the mandrel without damaging the electroformed article or the mandrel. Generally, the surfaces of the mandrel should be substantially parallel to the axis of the mandrel. Thus, the core mandrel should have a taper of less than about 0.001 inch per foot along the length of the core mandrel. This is to be distinguished from a core mandrel having a sharp taper which would not normally present any difficulties in so far as removal of an electroformed article from the mandrel. This taper, of course, refers to the major surfaces of the mandrel and not to an end of the mandrel.

The radius of the mandrel may be of any suitable size. Typical radii range from about 3 millimeters to about 3 meters. However, radii outside these ranges may also be used.

The shape of the ellipse may be defined by the formula:

$$y = \pm b/a \sqrt{(a^2 - x^2)}$$

where:

a=½ the length of the major axis of the ellipse and has a value between about 2.3b and about 1.7b, b=½ the height of the minor axis of the ellipse (i.e. the radius of the mandrel) and has a value at least about 1,000 times greater than the thickness of the plated metal coating on the parallel sides, and x and y define a point lying along the outer surface of the ellipse measured from the center of the ellipse The major axis of the ellipse lies along the axis of the cylindrical mandrel core in solid mandrels and axially along the inner surface in hollow mandrels. In either case, the value of "b" should be at least about 1,000 times greater than the thickness of the protective plating that is applied to the parallel sides of the mandrel core. This minimum value is necessary to prevent the formation of an undesirable bulge during formation of the protective plating. Thus, for solid mandrel cores, the radius of the mandrel core should be at least about 1,000 times greater than the thickness of the protective plating that is applied and the thickness of the wall of a hollow mandrel core should be at least about 1,000 times greater than the thickness of the protective plating that is applied. Satisfactory results may be achieved where a is between about 2.3b and about 1.7b. When a exceeds about 2.3b, a bulge forms in the plated coating near the tip of the mandrel along both the outside surface and within the bleed hole at the tip of the mandrel core that tends to fill in the hole. Due to the bulge, the electroformed article sides do not continuously taper toward the tip of the mandrel thereby causing the electroform to be locked in place. This undesirable result is illustrated in FIG. 5 of the drawings as described in detail hereinbelow. Moreover, a filled in bleed hole impedes parting because air or water cannot readily enter to break the vacuum/suction between the mandrel. When a is less than about 1.7b, a bulge in the plated coating forms at about the point where the curve of the tapered mandrel core end begins, i.e. where the ellipsoid shaped curve joins the parallel sides of the mandrel core. This bulge also locks the electroformed article part to mandrel. Preferably, a is a value between about 2.1b and about 1.9b. Optimum results are achieved when the end of the mandrel has the shape of a curve in which a=2b. when a is less than about 1.7, e.g., when a=b, a bulge occurs in the coating at the intersection between the parallel sides of the mandrel and the curve portion of the end of the mandrel. This bulge prevents or impedes removal of the electroformed article from the mandrel.

An optional hole or slight depression at the end of the mandrel is desirable to function as a bleeding hole to facilitate more rapid removal of the electroformed article from the mandrel. The bleed hole prevents the deposition of metal at the apex of the tapered end of the mandrel during the electroforming process so that ambient air may enter the space between the mandrel and the electroformed article during removal of the article subsequent to electroforming. Although a bleed hhole may be omitted from the mandrel, the time required to remove the electroformed article from the mandrel becomes longer. The bleed hole should have sufficient depth and circumference to prevent hole blocking deposition of metal during electroforming. For small diameter mandrel cores having a diameter (i.e. 2b) between about 1/16 inch (0.2 mm) and about 2.5 inches (63.5 mm) a typical dimension for bleed hole depth ranges from about 3 mm to about 14 mm and a typical dimension for circumference ranges from about 5 mm and about 15 mm. Thus, a bleed hole depth of between about a/8 and about a/2 and a circumference between about a/5 and about a/1.7 is satisfactory for small diameter cores. Other mandrel core diameters such as those greater than about 63.5 mm may also utilize suitable bleed holes having dimensions within and outside these depth and circumference ranges. Other factors to consider when selecting the minimum size of the bleed hole are the thickness of protective plting, the thickness of the electroformed article and the speed desired for removal of the electroformed article (e.g. attempts to rapidly remove a thin electroformed article from a mandrel can cause collapse of the article if the hole is not large enough to let in sufficient air to compensate for the partial vacuum that tends to form). Another factor to consider when selecting the maximum size of the bleed hole is the diameter of the mandrel used. Generally, for large diameter mandrels, the mandrel core may have a sleeve type configuration to conserve core material and to reduce mandrel weight. For large diameter mandrel cores having a diameter of at least about 6.35 cm and having a sleeve type configuration, a sleeve wall thickness of at least about 0.5 inch (1.27 cm) is preferred for greater rigidity, with optimum rigidity being achieved with wall thickness of at least about 0.7 inch (1.8 cm). However, thinner walls may be utilized, particularly when the wall is supported by suitable means such as a closely fitted inner liner or sleeve. In any event, the wall thickness, should be at least about 1,000 times greater than the thickness of the protective plating that is applied to the parallel walls of the mandrel core. Obviously, a large diameter sleeve having a relatively thin wall will have an interior opening sufficient to prevent plating over the end of the mandrel, thereby acting in a similar fashion as a bleed hole. For such a mandrel, it may be desirable that the interior of the mandrel be coated or covered with a masking agent to prevent deposition of material within the interior of the mandrel.

If an optional bleed hole is employed, a cross section of the transition at the end (apex or tip) of the mandrel from the outer surface of the curved primary ellipse shaped mandrel end surface to the inner surface of the bleed hole should be in the shape of an ellipse. The radius of curvature of this "secondary" ellipse extending from the outer surface of the "primary" ellipse to the interior surface of the bleed hole should preferably follow the formula:

$$y' = \pm b'/a' \sqrt{(a'^2 - x'^2)}$$

where:

a'=½ the length of the major axis of the secondary ellipse and has a value between about 1b' and about 2.3b'

$b' = \frac{1}{2}$ the height of the minor axis of the secondary ellipse extending from the inner bleed hole wall surface in a direction away from the axis of the cylindricxal mandrel core, and x' and y' define a point lying along the outer surface of the secondary ellipse measured from the center of the secondary ellipse.

Generally, for smaller diameter mandrel cores, the diameter of the bleed hole is smaller because less air can be used for parting and because mandrel wall thickness should be sufficiently thick to withstand repeated removal of electroformed articles. Thus, for example, progressively smaller maximum bleed hole diameters are desirable extending from about 0.29 mm for a bleed hole of a 2.5 mm diameter mandrel core to a bleed hole diameter of about 12 mm for a 100 mm diameter mandrel core. The major axis of the secondary ellipse also lies parallel to the axis of the cylindrical mandrel core. The ends of the arc described by the secondary ellipse should be tangent to the arc of the primary ellipse and tangent to the side of the bleed hole. The side of the bleed hole need not be parallel to the axis of the mandrel.

When $a' = b'$ (i.e. $a' = 1b'$), the secondary ellipse is a circle and the radius of curvature of this special version of the secondary ellipse can preferably follow the formula $R = a/10$ where $2a$ = the length of the primary ellipse, R being the radius of curvature. If R or b' are too small, a disproportionate amount of plated coating material will form around the tip of the mandrel which can close the bleed holw. If R or b' are too large, the primary elliptical taper of the end of the mandrel core will, in effect, be eliminated by the secondary elliptical taper and the entire end of the mandrel core will assume the shape of an undesirable semi-circle of the type illustrated in FIG. 6.

The plated coating is generally continuous except for areas that are masked or to be masked and may be of any suitable material. Typical plated protective coatings for mandrels include chromium, nickel, alloys of Nickel, iron, and the like. The plated metal should preferably be harder than the metal used to form the electroform and at least 0.006mm in thickness. The outer surface of the plated mandrel should also be passive, i.e. abhesive, relative to the metal that is electrodeposited to prevent adhesion during electroforming. Other factors that may be considered when selecting the metal for plating include cost, nucleation, adhesion, oxide formation and the like. Chromium plating is a preferred material for the outer mandrel surface because it has a naturally occurring oxide and surface resistive to the formation of a strongly adhering bond with the electro-deposited metal such as nickel. Therefore, when the nickel electroform is electroplated onto the chromium surface, it is just a matter of having the right stress conditions and the electroform slips right off of the mandrel. However, other suitable metal surfaces could be used for the mandrels.

The mandrel cores may be plated using any suitable electrodeposition process. Processes for plating a mandrel core are known and described in the patent literature. For example, a process for applying multiple metal platings to an aluminum mandrel core is described in U.S. Pat. No. 4,067,782. In this patent, a cylindrically shaped core member of aluminum or aluminum alloys is anodized as an anode in an anodizing zone containing a metal cathode of lead or lead alloys. The cathode and the core member anode are separated by an anodizing bath maintained at a temperature of from about 78° F. to 80° F. After the core member anode has been exposed to the bath from about 1 to 3 minutes, voltage is gradually applied. The voltage is raised to about 15 to 17 minutes. During this period, sufficient agitation is imparted to the anodizing bath to continuously expose the core member anode to fresh anodizing bath. Preferably, the core member anode is rotated at 1.5 to 3 rpm in order to obtain sufficient agitation. The anodizing bath is maintained within the zone at a stable equilibrium composition comprising:

2.7 to 3.7 parts conc. $H_3PO_4$ to 6.3 to 7.3 parts $H_2O$

The core member anode is then removed from the anodizing bath while the voltage is still being applied to the anodizing bath. The core member anode is rinsed with water sufficiently to remove the anodizing bath solution from the core member anode.

A nickel electroforming zone is then established comprising a metal anode selected from the group consisting of nickel and nickel alloys and a cathode comprising the mandrel core. The core cathode and anode are separated by a nickel bath maintained at a temperature of from about 132° to 138° F. A ramp current of from 10 to 20 amps per square feet is applied whren the core member cathode enters the nickel bath. As voltage of 3 volts is applied. The preferred rotation of the cathode at this point when the core member cathode enters the nickel bath of step is 28 to 32 rpm while the preferred voltage is maintained at 3 volts. The ramp current is increased over a period of at least 5 seconds to 75 to 150 amps per square feet.

There should be sufficient agitation imparted to the nickel bath to continuously expose the core member cathode to fresh nickel bath while maintaining the nickel bath within the nickel electroforming zone at a stable equilibrium composition comprising:

total nickel (e.g. nickel sulfate or nickel sulfamate) at 9 to 11 oz/gal, preferably 10 oz/gal halides as $NiX_2.6H_2O$ 1.0 to 1.4 oz/gal, preferably 1.2 oz/gal wherein X is selected from the groups consisting of chloride, iodine and bromine.

$H_3BO_3$ at 4.8 to 5.2 oz/gal, preferably 5 oz/gal.

The surface tension of the nickel bath is continuously maintained at 33 to 42 dynes per cm. The core member cathode is thereafter removed from the nickel bath while still imparting sufficient agitation to the nickel bath to continuously expose the core member cathode to fresh bath. The pH of the nickel bath may be 3.6 to 4.8, preferably 3.8 to 4.3. The preferred anode to core member cathode surface area ratio is 1.5 to 1. The the core member is removed from the nickel bath and rinsed with water to remove the nickel bath solution from the core member cathode.

After the nickel bath, one can plate a suitable metal such as chromium on the nickel plated mandrel core. For example, the nickel plated mandrel core is first washed with dilute solution of $H_2SO_4$ prior to chrome plating and then, optionally, immersed in an acid dip solution maintained at a temperature of from 65° F. to 75° F. having a pH of from1.7 to 2.0. Then mandrel core cathode, while the core member cathode is still wet from the rinse is placed into the acid dip solution for a period of 4 to 6 minutes while the core member cathode is being rotated at 28 to 30 rpm until the core member cathode is completely in the acid dip. Sufficient agitation should be imparted to the acid dip solution to continuously expose the core cathode to fresh acid dip solution while maintaining the acid dip solution within the zone at a stable equilibrium composition comprising:

$H_2SO_4$—0.08 to 0.18 oz/gal, preferably 0.13 oz/gal.

The core member cathode is removed from the acid dip solution and rinsed with water to remove the acid dip solution from the core cathode.

Preferably, the next step which is carried out prior to the core entering a chromium bath is a "pre-electrolyze" or "dummy bath" which is a process to achieve uniform conductivity and activity of the anodes. Otherwise a non-uniform or low current may be produced on the work. Also, local burned areas and other undesirable effects may be produced. The inactivity of the anodes which occurs during extended period of downtime usually results in passive films of lead chromates forming on these anodes. Therefore, the conventional practice of producing uniform activity by "pre-working" or "dummying" the chrome process may be used. The "dummy bath" may comprise providing a pre-cathode of lead which is placed in a chromium bath which is described below. The anode to cathode surface area ratio is at least 24 to 1 and this pre-cathode stays in the bath for at least 15 minutes with a current density of at least 200 amps. Then the pre-cathode is removed from the chromium bath prior to the core member cathode entering the below described chromium bath.

A chromium electroforming zone is established comprising a metal anode selected from the group consisting of lead or lead alloys preferably a lead alloy, for example, a lead/tin alloy, lead-antimony-silver alloy or a lead-chromium alloy. The cathode may comprise the mandrel core. The preferred anode to core cathode surface area ratio if 1 to 1. The anode and core member cathode are separated by the chromium bath maintained at a temperature of about 100° F. to 116° F. The core member cathode enters the chromium bath and remains in the chromium bath for at least 4 seconds before applying at least 200 amps per square feet of current density to the bath for a sufficient time to deposit at least 1 mil of chromium on the core member cathode. Sufficient agitation should be imparted to the chromium bath to continuously expose the core cathode to fresh bath while maintaining the bath within the chromium electroforming zone at a stable equilibrium composition comprising:

Trivalent chromium ($Cr^{+3}$) less than 0.5 oz/gal, preferably 0.0 oz/gal. (Trivalent chromium ($Cr^{+3}$) is not added as a compound but is produced in situ and is balanced by anions in the bath such as $CrO_4^{-2}$, $SO_4^{-2}$, etc.)

Chromic acid anhydride ($CrO_3$), Hexavalent chromium ($Cr^{+6}$) 30 to 35 oz/gal, preferably 33 oz/gal.

Fluoride ion (F-) (as fluorosilicate) 0.45 to 0.55 oz/gal, preferably 0.5 oz/gal.

Sulphate 0.15 to 0.25 oz/gal, preferably 0.2 oz/gal.

It is preferred to use any sulfate/fluoride or sulfate/-fluorosilicate catalyzed chromium bath under conditions which will produce deposits of chromium with a surface crack density of from about 400 to 800 cracks per linear inch. The plated mandrel core cathode is thereafter removed from the chromium bath solution. The entire disclosure of U.S. Pat. No. 4,067,782 is incorporated herein by reference.

Articles may be formed on the plated mandrels of this invention by any suitable electroforming process. Process for electroforming articles on the mandrel are also well known and described, for example, in U.S. Pat. No. 4,501,646 and U.S. Pat. No. 3,844,906. The entire disclosures of these two patents are incorporated herein by reference. The electroforming process of this invention may be conducted in any suitable electroforming device. For example, a plated cylindrically shaped mandrel having an ellipsoid shaped end may be suspended vertically in an electroplating tank. The electrically conductive mandrel plating material should be compatible with the metal plating solution. For example, the mandrel plating may be chromium. The top edge of the mandrel may be masked off with a suitable non-conductive material, such as wax to prevent deposition. the electroplating tank is filled with a plating solution and the temperature of the plating solution is maintained at the desired temperature. The electroplating tank can contain an annular shaped anode basket which surrounds the mandrel and which is filled with metal chips. The anode basket is disposed in axial alignment with the mandrel. The mandrel is connected to a rotatable drive shaft driven by a motor. The drive shaft and motor may be supported by suitable support members. Either the mandrel or the support for the electroplating tank may be vertically and horizontally movable to allow the mandrel to be moved into and out of the electroplating solution. Electroplating current can be supplied to the electroplating tank from a suitable DC source. The positive end of the DC source can be connected to the anode basket and the negative end of the DC source connected to a brush and a brush/split ring arrangement on the drive shaft which supports and drives the mandrel. The electroplating current passes from the DC source to the anode basket, to the plating solution, the mandrel, the drive shaft, the split ring, the brush, and back to the DC source. In operation, the mandrel is lowered into the electroplating tank and continuously rotated about its vertical axis. As the mandrel rotates, a layer of electroformed metal is deposited on its outer surface. When the layer of deposited metal has reached the desired thickness, the mandrel is removed from the electroplating tank and immersed in a cold water bath. The temperature of the cold water bath should preferably be between about 80° F. and about 33° F. When the mandrel is immersed in the cold water bath, the deposited metal is cooled prior to any significant cooling and contracting of the solid mandrel to impart an internal stress of between about 40,000 psi and about 80,000 psi to the deposited metal. Since the metal cannot contract and is selected to have a stress-strain hysteresis of at least about 0.00015 in/in, it is permanently deformed so that after the core mandrel is cooled and contracted, the deposited metal article may be removed from the mandrel.

If desired, electroforming processes can be used other than that disclosed in U.S. Pat. No. 4,501,646 as described above. Thus, for example, the electroforming process described in U.S. Pat. No. 4,501,646 may be used for electroformed articles having alrger diameter/-mass mandrels. The entire disclosure of U.S. Pat. No. 4,501,646 is incorporated herein by reference.

The deposited metal article does not adhere to the plated metal coatig on the mandrel core because the coating is selected froma passive material. Consequently, as a parting gap is formed between the mandrel and the electroformed metal article, the electroformed metal article may bne readily slipped off the mandrel.

A suitable electroforming apparatus for carrying out the process described above except for use use of a mandrel having an ellipsoid shaped end is described, for example, in British Pat. No. 1,288,717, published Sept. 13, 1972. The entire disclosure of this British patent specification is incorporated herein by reference.

A typical electrolytic cell for depositing metals such as nickel may comprise a tank containing a rotary drive means including a mandrel supporting drive hub centrally mounted thereon. The drive means may also provide a low resistance conductive element for conducting a relatively high amperage electrical current between the mandrel and a power supply. The cell is adapted to draw, for example, a peak current of about 3,000 amperes DC at a potential of about 18 volts. Thus, the mandrel comprises the cathode of the cell. An anode electrode for the electrolytic cell comprises an annular shaped basket containing metallic nickel which replenishes the nickel electrodeposited out of the solution. The nickel used for the anode comprises sulfur depolarized nickel. Suitable sulfur depolarized nickel is available under the tradenames, "SD" Electrolytic Nickel and "S" Nickel Rounds from International Nickel Co. Non sulfur depolarized nickel can also be used such as carbonyl nickel, electrolytic nickel and the like. The nickel may be in any suitable form or configuration. Typical shapes include buttons, chips, squares, strips and the like. The basket is supported within the cell by an annular shaped basket support member which also supports an electroforming solution distributor manifold or sparger which is adapted to introduce electroforming solution to the cell and effect agitation thereof. A relatively high amperage current path within the basket is provided through a contact terminal which is attached to a current supply bus bar.

The plated coating on the mandrel of this invention hs a substantially uniform thickness on the parallel sides of the mandrel core. Also the cross sectional profile of the plated metal coating on the curved sides of the mandrel end in the direction from the the parallel sides to the apex is inclined toward the apex or parallel to the axis of the mandrel. This configuration ensures that there are no protrusions in the plated metal coating that would impde removal of the electroformed article from the ellipsoid shaped end of the mandrel.

BRIEF DESCRIPTION OF THE DRAWINGS

A more complete understanding of the process of the present invention can be obtained by reference to the accompanying drawings wherein.

DETAILED DESCRIPTION OF THE DRAWINGS

Figure 1:
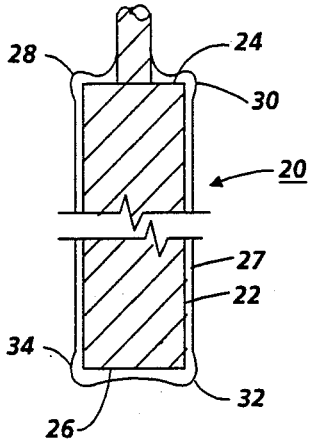
FIG. 1 is a schematic illustration of a cross section of a plated prior art mandrel having flat ends.

Referring to FIG. 1, a cross section of a plated prior art mandrel 20 is shown, comprising a cylindrical core 22, a having flat ends 24 and 26. A plated coating 27 formed by electrolytic plating is substantially uniform along most of the parallel sides of core 22, but has thicker plated deposits 28, 30, 32 and 34 at the points where the parallel sides of core 22 meet mandrel flat ends 24 and 26. An article electroformed on this plated mandrel cannot be slid past these thicker plated deposits 28, 30, 32 and 34.

Figure 2:
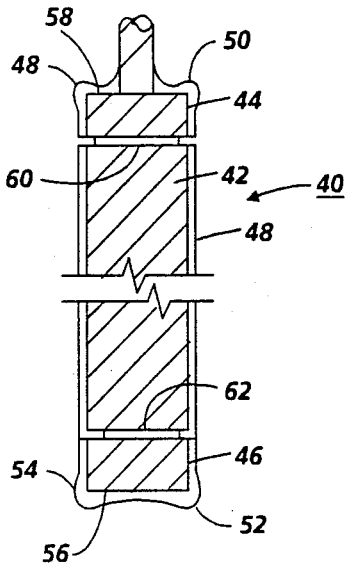
FIG. 2 is a schematic illustration of a cross section of a plated prior art mandrel having flat ends protected with a robber.

Illustrated in FIG. 2 is a cross section of a plated prior art mandrel 40 comprising a cylindrical core 42, and disk shaped electrically conductive robbers 44 and 46 fastened to the flat ends of the mandrel core 42. A plated coating 48 formed by electrolytic plating is substantially uniform along most of the parallel sides of core 42, but has thicker plated deposits 48, 50, 52 and 54 at the junction where the parallel sides of robbers 44 and 46 meet flat ends 56 and 58. Although plated deposits form in the crevasse formed at the junction of the robbers 44 and 46 and the ends 60 and 62 of clindrical core 42, these deposits do not fully cover the ends of cylindrical core 42 and, therefore, do not provide adequate protection against corrosion during electroforming. The robbers 44 and 46 must be removed prior to electroforming articles on the mandrel and, unless masked, the unplated ends 60 and 62 of cylindrical core 42 are exposed to the life shortening corrosive influence of the electroforming bath.

Figure 3:
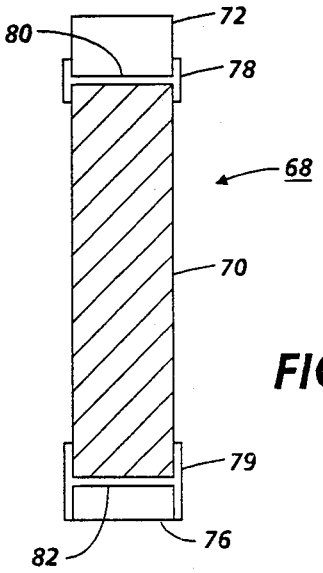
FIG. 3 is a schematic illustration of a cross section of an unplated prior art mandrel having flat ends protected with a robber and a ring shaped shield.

Referring to FIG. 3, a cross section of an unplated prior art mandrel 68 is shown, comprising a cylindrical core 70, disk shaped electrically conductive robbers 72 and 76 fastened to the flat ends of the mandrel core 70, and a ring shaped shields 78 and 79 covering the crevasse formed at the junction of the robbers 72 and 76 and the ends 80 and 82 of cylindrical core 70. The robbers 72 and 76 and ring shaped shields 78 and 79 must be removed prior to electroforming articles on the mandrel and, unless masked, the unplated ends 80 and 82 of cylindrical core 70 are exposed to the life shortening corrosive influence of the electroforming bath.

Figure 4:
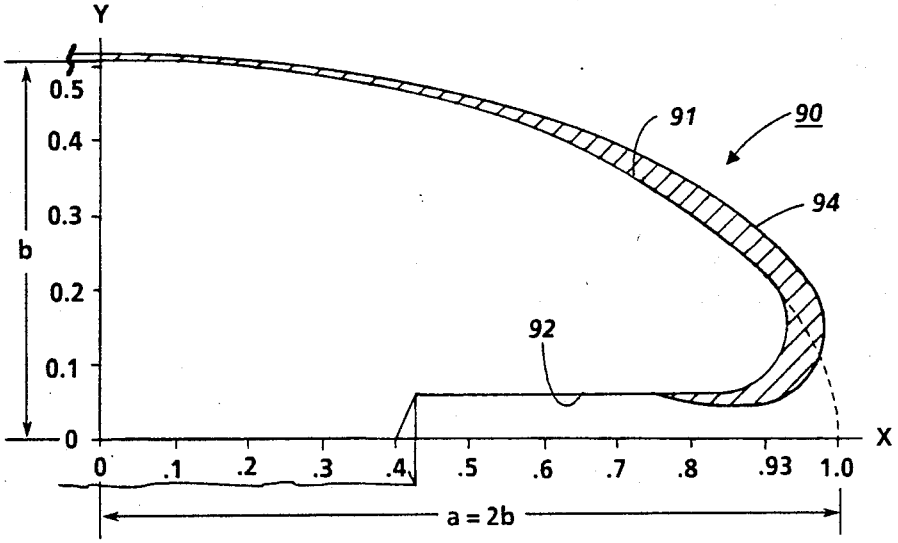
FIG. 4 is a schematic illustration of a cross section of a plated mandrel having an ellipsoid shaped end and an ellipse shaped curve at a bleed hole.

A cross section of the upper half of a plated end 90 of a mandrel embodiment of this invention is illustrated in FIG. 4. The tapered end 91 of the mandrel core has an ellipsoidal shape. A profile of an axial cross section of the tapered end 91 from the intersection between the curved sides and the parallel sides to about the apex has the shape of half an ellipse defined by the formula:

$$y = \pm b/a \sqrt{(a^2 - x^2)}$$

where:

$a = \frac{1}{2}$ the length of the major axis of the ellipse and has a value of 2b.

$b = \frac{1}{2}$ the height of the minor axis of the ellipse (i.e. the length of the radius of the mandrel core), and x and y define a point lying along the outer surface of the ellipse measured from the center of the ellipse.

Because of the presence of a bleed hole 92, the shape of the mandrel end at the apex departs from a true primary elliptical shape shown by the dashed line. More specifically, the transition at the end of the mandrel adjacent the bleed hole 92 from the outer surface of the curved sides to the inner surface of the bleed hole is also in the shape of a "secondary" ellipse. The radius of curvature of this secondary ellipse extending from the outer surface of the primary ellipse to the interior surface of the bleed hole follows the formula:

$$y' = \pm b'/a' \sqrt{(a'^2 - x'^2)}$$

where:

- $a' = \frac{1}{2}$ the length of the major axis of the secondary ellipse,
- $b' = \frac{1}{2}$ the height of the minor axis of the secondary ellipse extending from the inner bleed hole wall surface 92 in a direction away from the axis of the cylindrical mandrel core, and
- $x'$ and $y'$ define a point lying along the outer surface of the secondary ellipse measured from the center of the secondary ellipse.

The major axis of the secondary ellipse also lies parallel to the axis of the cylindrical mandrel core. The ends of the arc described by the secondary ellipse are tangent to the arc of the primary ellipse and tangent to the inner bleed hole wall surface 92. Also, in the embodiment shown in FIG. 4, $a' = b'$, so the secondary ellipse is a circle and the radius of curvature of this secondary ellipse follows the formula $R = a/10$ where $a = \frac{1}{2}$ length of primary ellipse, R being the radius of curvature. Thus, $a' = a/10$. Due to the shape of the mandrel end 91, an imaginary line tangent to any point along the cross sectional profile of the plated metal coating 94 on the curved sides of the mandrel end 91 in the direction from the the parallel sides (not shown) to the apex is inclined toward the apex. This configuration ensures that there are no protrusions in the plated metal coating that would impede removal of an electroformed article from the plated ellipsoid shaped end 90 of the mandrel. Also, the bleed hole remains open.

Figure 5:
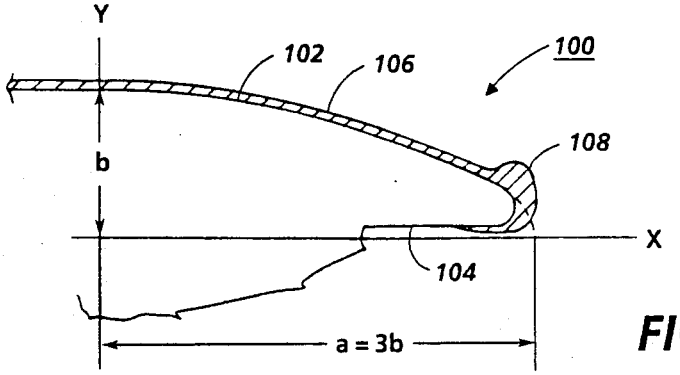
FIG. 5 is a schematic illustration of a cross section of a plated mandrel having a gradually curved end and an ellipse shape curve at a bleed hole.

Referring to FIG. 5, a cross section is shown of the upper half of an ellipsoidal shaped plated end 100 of a mandrel. The elliptical shape of most of the mandrel end 102 prior to plating is defined by the formula:

$$y = \pm b/a \sqrt{(a^2 - x^2)}$$

and $a = 3b$ and $b$ = the radius of the mandrel. Adjacent bleed hole 104, the shape of the mandrel end at the apex departs from a true elliptical shape shown by the dashed line. The transition at the end of the mandrel adjacent the bleed hole 104 from the outer surface of the curved sides to the inner surface of the bleed hole is also in the shape of an ellipse. The radius of curvature in this illustrated embodiment follows the formula $R = a/10$ where $a = a$ of the primary ellipse. Due to the shape of the mandrel end 102, an imaginary line tangent to some points along the cross sectional profile of the plated metal coating 106 on the curved sides of the mandrel end 102 in the direction from the the parallel sides (not shown) to the apex is not inclined toward the apex. More specifically, the bulge 108 in the plated metal coating 106 near the tip of the mandrel core along both the outside surface and within the bleed hole tends to fill in the hole and also prevents removal of an electroformed article from the plated ellipse shaped end 100 of the mandrel.

A cross section of the upper half of a plated end 110 of a mandrel embodiment of this invention is illustrated in FIG. 5. The elliptical shape of most of the mandrel end 112 prior to plating is defined by the formula:

$$y = \pm b/a \sqrt{(a^2 - x^2)}$$

and $a = b$ and $b$ = the radius of the mandrel. Adjacent bleed hole 114, the shape of the mandrel end at the apex departs from a true elliptical shape shown by the dashed line. The transition at the end of the mandrel adjacent the bleed hole 114 from the outer surface of the curved sides to the inner surface of the bleed hole is also in the shape of an ellipse. The radius of curvature in this illustrated embodiment follows the formula $R = a/10$ where $a = a$ of primary ellipse. Due to the shape of the mandrel end 112, an imaginary line tangent to some points along the cross sectional profile of the plated metal coating 116 on the curved sides of the mandrel end 112 in the direction from the the parallel sides 118 to the apex is not nclined toward the apex. More specifically, the bulge 120 in the plated metal coating 106 where the ellipsoid joins the parallel sides 118 impedes removal of an electroformed article from the plated mandrel.

The invention will now be described in detail with respect to the specific preferred embodiments thereof, it being understood that these examples are intended to be illustrative only and that the invention is not intended to be limited to the materials, conditions, process parameters and the like recited herein. All parts and percentages are by weight unless otherwise indicated.

EXAMPLE I

A cylindrically shaped, solid aluminum mandrel core of 6061-T6-QQA aluminum, available from Aluminum Company of America, approximately 1 inch (2.54 cm) in diameter and about 21 inches (5.34 cm) long was provided. The surface of the outside of the core was very smooth without any visible defects, i.e. free of nicks, scratches and tool marks. The RMS (route mean square) which is a measurement of the surface smoothness, measured in microinches of about 3 to 5 microinches. One end of the core was machined to form an ellipsoid shape similar to the shape of the mandrel core end illustrated in FIG. 4. The elliptical shape of most of the mandrel core end prior to plating was defined by the formula:

$$y = \pm b/a \sqrt{(a^2 - x^2)}$$

and $a = 25.4$ mm and $b = 12.7$ mm (i.e. $a = 2b$), and $b = \frac{1}{2}$ the height of the minor axis of the ellipse (i.e. the radius of the mandrel). A bleed hole having a diameter of 3.175 mm and a depth of 12.7 mm was drilled at the apex of the ellipsoid shaped end of the mandrel core. Relative to "a", the dimensions of this drilled hole was a/2 deep and a/8 in diameter. The shape of the mandrel end at the apex adjacent the bleed hole was also machined so that the transition at the end of the mandrel core adjacent the bleed hole from the outer surface of the curved sideds to the inner surface of the bleed hole was also in the shape of an ellipse. The radius of curvature a cross section of the mandrel core end adjacent the bleed hole followed the formula $R = a/10$ where $a = 25.4$ mm. Due to the secondary ellipse shape formed adjacent the bleed hole, the actual axial length of the ellipse shaped end as measured from the center of the primary ellipse shape is 0.93 a and "a" is merely a theoretical measurement for calculation purposes.

The mandrel core was blown free of grit or dirt or any foreign material which might cause damage and cleaned by washing with acetone to remove any oil, etc. The upper surface which was not to be plated was masked. The core was secured to a hoist so that the core could be moved between various baths. The lower tapered end of the mandrel core was not covered or connected to "robbers". The mandrel core was given another complete cleaning with acetone and wiped with a paper cloth dampened with acetone to remove any organic contaminates.

The mandrel core was then scrubbed with a nylon pad, i.e. Scotch Brite ®, and alpha alumina, a polishing powder. The alpha alumina was very fine about 0.3 micrometer. The mandrel core was thereafter scrubbed in two different directions with a paper towel and then alpha alumina. All traces of the alpha alumina was removed by flushing the mandrel core with deionized water while rubbing the surface with paper towel (Litho Wipes ®) until there was no black residue on the paper towel. During this process, deionized water was cascaded over the mandrel.

The mandrel was then moved to the anodizing bath. The bath contained 3 parts 85 percent $H_3PO_4$ to 10 parts deionized water. The temperature of the bath was about 79° F. The cathode was of lead and the cathode to anode, i.e. mandrel core surface area ratio was 1 to 1. The mandrel core, while still wet from the dionized water rinse, entered the bath with no voltage applied to the bath. The mandrel core was slowing rotated at about 2.5 rpm in the anodizing bath for 2 minutes. The voltage was increased slowly to 16 volts while the mandrel remained immersed in the anodizing bth for about 15 minutes. The mandrel core was removed from the anodizing bath while the voltage was still being applied. A "full rinse" was begun as soon as the mandrel core cleared the tank to remove all residue of the previous bath before the mandrel entered the next bath. In the "full rinse", deionized water was directed from a ¾ inch pipe at about 1.5 to 2 gallons per minute onto the mandrel while the mandrel was being rotated at about 7 to 10 rpm for at least 6 complete revolutions. The flow of water was then increased to about 5 gallons per minute while rotating the mandrel at about 30 to 40 rpm. The rotation of the mandrel core was thereafter slowed to 7 to 10 rpm while rinsing with deionized water at 1.5 to 2 gallons per minute.

The mandrel core was then moved to a nickel bath while it was still wet from the rinse step. The nickel bath contained nickel at a concentration of 10 oz/gallon, $NiCl_2.6H_2O$ at a concentration of 1.2 oz/gallon, and $H_3BO_3$ at a concentration of 5 oz/gallon. The surface tension was about 38 dynes per cm, pH was about 4.1 and the temperature was about 135° F. The anode was nickel and the anode to cathode, i.e. mandrel, surface area ratio was 1.5 to 1. The mandrel core entered the nickel bath while a voltage of about 3 volts at 15 amps was applied. The mandrel was rotated at about 30 rpm. As soon as the mandrel was completely immersed in the bath, the rotation of the mandrel was increased to 350 rpm and the current, was ramped upwardly over a period of 30 seconds from about 15 amps to about 100 amps per square feet. The bath was continuously filtered with a skimmer to constantly remove residue from the top of the bath. The mandrel core remained in the bath long enough to plate 1.0 mil of nickel. After the plating was completed, the plated mandrel was slowly rotated at about 29 rpm during removal from the nickel bath. A "quick rinse" was initiated as soon as the mandrel started to clear the nickel bath. The "quick rinse" was the same as the "full rinse" described previously in this example.

The mandrel entered an acid dip bath immediately after the rinse, i.e. post nickel bath rinse. The mandrel was still wet from the rinse. The acid dip bath comprised 0.13 ounces of $H_2SO_4$ per gallon maintained at a temperature 70° F. and a pH of 1.85. While being rotated while it enters the acid dip bath at 29 rpm, the mandrel entered the acid dip bath with no voltage being applied. As soon as the mandrel was completely immersed in the acid dip bath, rpm was increased to 35. These conditions were maintained for at least 1 minute. Then the rpm was increased to 12.5 rpm for 5 minutes. A "quick rinse" was initiated as soon as the mandrel started to clear the acid dip bath. The "quick rinse" was the same as the "full rinse" described previously in this example.

The mandrel was then moved to a chromium plating bath. The chromium bath contained 33 oz/gallon hexavalent chromium, 0.50 oz/gallon of fluorosilicate present in order to furnish F- ion and 0.2 oz/gallon of sulfate. The bath was at about 112° F. and the anode was lead/tin alloy. The anode to cathode, i.e. mandrel, surface area ratio was 1 to 1. The chromium bath was "dummied" for 15 minutes prior to the mandrel entering the bath. A lead/tin alloy cathode was used with the lead/tin alloy anode, the anode to cathode surface area ratio was 24 to 1 and the current density was 200 amps. This activates the anodes for later use.

While still wet from the previous rinse, the mandrel was immersed in the chromium bath while rotating at about 5 rpm and was maintained in the chromium bath for at least about 4 seconds before any current was applied. A current of about 200 amps per square feet was applied with no ramping. The mandrel was allowed to remain in the bath until about 1 mil of chromium was plated onto the mandrel. The resulting chrome plated mandrel was removed from the bath, cleaned and examined. There were no protrusions in the plated metal coating that would impede removal of an electroformed article from the plated ellipsoid shaped end of the mandrel.

EXAMPLE II

The procedures described Example I was repeated except that different mandrel core was used. This new core was also a cylindrically shaped, solid aluminum core of 6061-T6-QQA aluminum, available from Aluminum Company of America, approximately 1 inch (2.54 cm) in diameter and about 21 inches (53.34 cm) long was provided. The surface of the outside of the core was very smooth without any visible defects, i.e. free of nicks, scratches and tool marks. The RMS (route mean square) was about 3 to 5 microinches. One end of the core was machined to form an ellipsoid shape similar to the shape of the mandrel end illustrated in FIG. 5. The elliptical shape of most of the mandrel end prior to plating was defined by the formula:

$$y = \pm b/a \sqrt{(a^2 - x^2)}$$

and a=38.1 mm and b=12.7 mm (i.e. a=3b), and b=the radius of the mandrel. A bleed hole having a diameter of 3.18 mm and a depth of 12.7 mm was drilled at the apex of the ellipsoid shaped end of the mandrel core. The shape of the mandrel core end at the apex adjacent the bleed hole was also machined so that the transition at the end of the mandrel core adjacent the bleed hole from the outer surface of the curved sides to the inner surface of the bleed hole was also in the shape of an ellipse. The radius of curvature of a cross section of the mandrel core end adjacent the bleed hole followed the formula R=a/30 where a=38.1 mm. After chrome plating, the plated mandrel was removed from the bath, cleaned and examined. A bulge in the plating at the apex of the ellipse along both the outside surface and within the bleed hole was observed which would impede removal of an electroformed article from the plated ellipsoid shaped end of the mandrel.

EXAMPLE III

Figure 6:
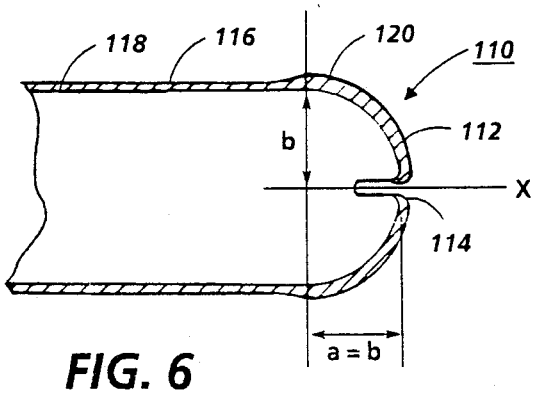
FIG. 6 is a schematic illustration of a cross section of a plated mandrel having a semi-circular end and a ellipse shape curve at a bleed hole.

The procedures described Example I was repeated except that different mandrel core was used. This new core was also a cylindrically shaped, solid aluminum core of 6061-T6-QQA aluminum, available from Aluminum Company of America, approximately 1 inch (2.54 cm) in diameter and about 21 inches (53.34 cm) long was provided. The surface of the outside of the core was very smooth without any visible defects, i.e. free of nicks, scratches and tool marks. The RMS (route mean square) was about 3 to 5 microinches. One end of the core was machined to form an ellipsoid shape similar to the shape of the mandrel end illustrated in FIG. 6. The elliptical shape of most of the mandrel end prior to plating was defined by the formula:

$$y = \pm b/a \sqrt{(a^2 - x^2)}$$

and a=12.7 mm and b=12.7 mm (i.e. a=b), and b=the radius of the mandrel. A bleed hole having a diameter of 3.18 mm and a depth of 12.7 mm was drilled at the apex of the ellipsoid shaped end of the mandrel core. The shape of the mandrel core end at the apex adjacent the bleed hole was also machined so that the transition at the end of the mandrel core adjacent the bleed hole from the outer surface of the curved sides to the inner surface of the bleed hole was also in the shape of an ellipsoid. The radius of curvature of a cross section of the mandrel core end adjacent the bleed hole followed the formula R=a/4 where a=12.7 mm. After chrome plating, the plated mandrel was removed from the bath, cleaned and examined. A bulge in the plating was observed where the curve of the tapered end joined the straight sides of the mandrel core. This bulge would impede removal of an electroformed article from the plated ellipsoid shaped end of the mandrel.

EXAMPLE IV

The mandrel prepared by the process of Example I was mounted to a lift apparatus, cleaned and heated to the temperature of a nickel belt plating bath used for plating nickel xerographic belts. The mandrel was then lowered into a plating cell. The cell contained a nickel belt plating bath. The general plating conditions were constant and are set forth below:

| | |
|---|---|
| Current Density | 285-amps/ft$^2$ |
| Agitation Rate (linear ft/sec solution flow over the cathode surface) | 4–6 |
| pH | 3.8–3.9 |
| Surface Tension (dynes/cm | 33–39 |
| $H_3BO_3$ | 4–5 oz/gal |
| Sodium Lauryl Sulfate | 0.0007 oz/gal |
| $NiCl_2.6H_2O$ (oz/gal) | 6 |
| Anode | electrolytic |
| Plating Temp. (°F.) $T_2$ | 140 |
| Delta T ($T_2$–$T_1$) | 100° F. |
| Parting Gas (in) at | 0.00026 |
| $T_1$ (Parting Temp. °F.) | 40 |

The nickel was electroformed onto the mandrel to a thickness of about 5 mils (0.127 mm). The plating was applied for about 20 minutes. Other deposition parameters included the following:

| | |
|---|---|
| Surface Roughness (micro inches, RMS) | 8 |
| Internal Stress, psi | −3,000 |
| Tensile Strength, psi | 93,000 |
| Elongation (percent in 2 in) | 12 |

The mandrel plus the electroformed article was removed from the cell and cooled at a temperature of about 40° F. (4.4° C.). The electroformed article was easily removed from the mandrel by sliding the article over the tapered end of the mandrel.

EXAMPLE V

The procedures described Example IV was repeated except that the mandrel of Example II was used. The electroformed article could not be removed from the mandrel because the bulge in the plating at the apex of the ellipsoid prevented sliding of the article over the tapered end of the mandrel.

EXAMPLE VI

The procedures described Example IV was repeated except that the mandrel of Example III was used. The electroformed article could not be removed because the bulge in the plating where the curve of the tapered end joined the straight sides of the mandrel core prevented sliding of the article over the tapered end of the mandrel.

EXAMPLE VII

The procedures described Example I was repeated except that a different mandrel core was used. This new core was a cylindrically shaped, hollow aluminum sleeve of aluminum approximately 21 inches (53.34 cm) in diameter and about 22 inches (55.88 cm) long was provided. The wall of the sleeve was about 1 inch thick (2.54 cm). The surface of the outside of the core was very smooth without any visible defects, i.e. free of nicks, scratches and tool marks. One end of the sleeve was machined to form a cross section having an elliptical shape. The elliptical shape of most of the mandrel core end prior to plating was defined by the formula:

$$y = \pm b/a \sqrt{(a^2 - x^2)}$$

and a=50.8 mm and b=25.4 mm (i.e. a=2b), and b=the wall thickness of the mandrel. The cylindrically shaped hollow interior defined an area sufficient to prevent plating over the end of the mandrel. The shape of the mandrel core end at the apex adjacent the entrance to the cylindrically shaped hollow interior was also machined so that the transition at the end of the mandrel core adjacent the entrance from the outer surface of the curved sides to the inner surface of the cylindrically shaped hollow interior was also in the shape of an ellipse. The radius of curvature of a cross section of the mandrel core end adjacent the interior of the mandrel followed the formula $R=\frac{1}{4}$ where a=2 inches (5.1 cm). The resulting chrome plated mandrel was removed from the bath, cleaned and examined. There were no protrusions in the plated metal coating that would impede removal of an electroformed article from the plated ellipsoid shaped end of the mandrel.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A cylindrical electroforming mandrel comprising a substantially cylindrical mandrel core having substantially parallel sides and at least one tapered end having curved sides which converge toward an apex, and a plated metal coating on said parallel sides and said tapered end, the profile of an axial cross section of said tapered end from the intersection between said curved sides and said parallel sides to about said apex having the shape of half an ellipse defined by the formula:

$$y = \pm b/a \sqrt{(a^2 - x^2)}$$

where:

$a=\frac{1}{2}$ the length of the major axis of said ellipse and has a value between about 2.3b and about 1.7b, $b=\frac{1}{2}$ height of the minor axis of said ellipse and has a value at least about 1,000 times greater than the thickness of said plated metal coating on said parallel sides, and x and y define a point lying along the outer surface of said ellipse measured from the center of the ellipse.

2. A cylindrical electroforming mandrel according to claim 1 wherein said plated metal coating on said mandrel core has a substantially uniform thickness on said parallel sides and an imaginary line tangent to points on the outer surface of said plated metal coating on said curved sides of said tapered end in the direction from said parallel sides to said tapered end is inclined toward said end or parallel to the axis of said mandrel.

3. A cylindrical electroforming mandrel according to claim 1 wherein a has a value between about 2.1b and abut 1.9b.

4. A cylindrical electroforming mandrel according to claim 1 wherein a has a value equal to about 2b.

5. A cylindrical electroforming mandrel core according to claim 1 wherein said mandrel core has a bleed hole adjacent said apex.

6. A plated cylindrical electroforming mandrel core according to claim 5 wherein the axial cross section of the transition at the tip of said mandrel core from the outer surface of the curved primary ellipse shaped mandrel core end surface to the inner surface of said bleed hole has the shape of a second ellipse, the radius of curvature of said second ellipse extending from the outer surface of said primary ellipse to the interior surface of said bleed hole defined by the formula:

$$y' = \pm b'/a' \sqrt{(a'^2 - x'^2)}$$

where:

$a'=\frac{1}{2}$ the length of the major axis of said second ellipse and has a value between about 1b′ and about 2.3b′

$b'=\frac{1}{2}$ the height of the minor axis of said second ellipse extending from said interior surface in a direction away from the axis of said mandrel core, and x′ and y′ define a point lying along the outer surface of said secondary ellipse measured from the center of said second ellipse, the ends of the arc described by said second ellipse being tangent to the arc of the primary ellipse and tangent to the side of said bleed hole.

7. A cylindrical electroforming mandrel core according to claim 1 wherein said mandrel core is solid and said major axis of said ellipse lies along the axis of said mandrel core in solid mandrels.

8. A cylindrical electroforming mandrel core according to claim 1 wherein said mandrel core is a hollow sleeve having an inner surface concentric with an outer surface and said major axis of said ellipse lies axially along said inner surface of said hollow mandrel.

9. A process for fabricating a plated cylindrical electroforming mandrel comprising providing a cylindrical mandrel core having substantially parallel sides and at least one tapered end having curved sides which converge toward an apex, the profile of an axial cross section of said tapered end from the intersection between said curved sides and said parallel sides to about said apex having the shape of half an ellipse defined by the formula:

$$y = \pm b/a \sqrt{(a^2 - x^2)}$$

where:

$a=\frac{1}{2}$ the length of the major axis of the ellipse and has a value between about 2.3b and about 1.7b, $b=\frac{1}{2}$ the height of the minor axis of the ellipse and has a value at least about 1,000 times greater than the thickness of said plated metal coating on said parallel sides, and x and y define a point lying along the outer surface of the ellipse measured from the center of the ellipse and electroplating a metal coating onto said parallel sides and said tapered end of said mandrel core.

10. A process for fabricating a plated cylindrical electroforming mandrel according to claim 8 wherein said plated metal coating on said mandrel core has a substantially uniform thickness on said parallel sides and an imaginary line tangent to points on the outer surface of said plated metal coating on said curved sides of said tapered end in the direction from said parallel sides to said tapered end is inclined toward said end or parallel to the axis of said mandrels.

11. A process for fabricating a plated cylindrical electroforming mandrel according to claim 8 wherein a has a value between about 2.1b and about 1.9b.

12. A process for fabricating a plated cylindrical electroforming mandrel according to claim 8 wherein a has a value equal to about 2b.

13. A process for fabricating a plated cylindrical electroforming mandrel according to claim 8 wherein said mandrel core has a bleed hole adjacent said apex.

14. A process for fabricating a plated cylindrical electroforming mandrel according to claim 13 wherein the axial cross section of the transition at the tip of said mandrel core from the outer surface of the curved primary ellipse shaped mandrel core end surface to the inner surface of said bleed hole has the shape of a second ellipse, the radius of curvature of said second ellipse extending from the outer surface of said primary ellipse to the interior surface of said bleed hole defined by the formula:

$$y' = \pm b'/a' \sqrt{(a'^2 - x'^2)}$$

where:

$a' = \frac{1}{2}$ the length of the major axis of said second ellipse and has a value between about 1b' and about 2.3b'

$b' = \frac{1}{2}$ the height of the minor axis of said second ellipse extending from said interior surface in a direction away from the axis of said mandrel core, and x' and y' define a point lying along the outer surface of said secondary ellipse measured from the center of said second ellipse, the ends of the arc described by said second ellipse being tangent to the arc of the primary ellipse and tangent to the side of said bleed hole.

15. A process for fabricating a plated cylindrical electroforming mandrel according to claim 8 wherein said mandrel core is solid and said major axis of said ellipse lies along the axis of said mandrel core in solid mandrels.

16. A process for fabricating a plated cylindrical electroforming mandrel according to claim 8 wherein said mandrel core is a hollow sleeve having an inner surface concentric with an outer surface and said major axis of said ellipse lies axially along said inner surface of said hollow mandrel.

17. An electroforming process comprising providing a cylindrical electroforming mandrel comprising a substantially cylindrical mandrel core having substantially parallel sides and at least one tapered end having curved sides which converge toward an apex and a plated metal coating on said parallel sides and said tapered end, the profile of an axial cross section of said tapered end from the intersection between said curved sides and said parallel sides to about said apex having the shape of half an ellipse defined by the formula:

$$y = \pm b/a \sqrt{(a^2 - x^2)}$$

where:

$a = \frac{1}{2}$ the length of the major axis of said ellipse and has a value between about 2.3b and about 1.7b, $b = \frac{1}{2}$ the height of the minor axis of said ellipse and has a value at least about 1,000 times greater than the thickness of said platd metal coating on said parallel sides, and x and y define a point lying along the outer surface of said ellipse measured from the center of said ellipse, immersing said electrode in a plating bath, electroforming an electroformed layer on said plated metal coating to form an electroformed article, and removing said electroformed article from said mandrel by sliding said electroformed artcle over said tapered end of said mandrel.

18. An electroforming process according to claim 17 wherein a has a value between about 2.1b and about 1.9b.

19. An electroforming process according to claim 17 wherein a has a value equal to about 2b.

20. An electroforming process according to claim 17 wherein said plated metal coating on said mandrel core has a substantially uniform thickness on said parallel sides and an imaginary line tangent to points on the outer surface of said plated metal coating on said curved sides of said tapered end in the direction from said parallel sides to said tapered end is inclined toward said end or parallel to the axis of said mandrel.

21. An electroforming process according to claim 17 wherein said mandrel core has a bleed hole adjacent said apex.

22. An electroforming process according to claim 21 wherein the axial cross section of the transition at the tip of said mandrel core from the outer surface of the curved primary ellipse shaped mandrel core end surface to the inner surface of said bleed hole has the shape of a second ellipse, the radius of curvature of said second ellipse extending from the outer surface of said primary ellipse to the interior surface of said bleed hole defined by the formula:

$$y' = \pm b'/a' \sqrt{(a'^2 - x'^2)}$$

where:

$a' = \frac{1}{2}$ the length of the major axis of said second ellipse and has a value between about 1b' and about 2.3b'

$b' = \frac{1}{2}$ the height of the minor axis of said second ellipse extending from said interior surface in a direction away from the axis of said mandrel core, and x' and y' define a point lying along the outer surface of said secondary ellipse measured from the center of said second ellipse, the ends of the arc described by said second ellipse being tangent to the arc of the primary ellipse and tangent to the side of said bleed hole.

23. An electroforming process according to claim 17 wherein said mandrel core is solid and said major axis of said ellipse lies along the axis of said mandrel core in solid mandrels.

24. An electroforming process according to claim 17 wherein said mandrel core is a hollow sleeve having an inner surface concentric with an outer surface and said major axis of said ellipse lies axially along said inner surface of said hollow mandrel.

* * * * *